US011017637B2

(12) United States Patent
Giuffria et al.

(10) Patent No.: US 11,017,637 B2
(45) **Date of Patent: *May 25, 2021**

(54) HYBRID WAGERING AND SKILL-BASED GAMING SYSTEM AND SERVER

(71) Applicant: INNOVATIVE WAGERING CONCEPTS, LLC, Las Vegas, NV (US)

(72) Inventors: Gregg Russell Giuffria, Las Vegas, NV (US); Joseph Baron Giuffria, Las Vegas, NV (US)

(73) Assignee: INNOVATIVE WAGERING CONCEPTS, LLC, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/279,752

(22) Filed: Feb. 19, 2019

(65) Prior Publication Data

US 2019/0188967 A1 Jun. 20, 2019

Related U.S. Application Data

(63) Continuation-in-part of application No. 14/793,549, filed on Jul. 7, 2015, now Pat. No. 10,210,697.

(51) Int. Cl.
*G07F 17/32* (2006.01)

(52) U.S. Cl.
CPC ..... *G07F 17/3267* (2013.01); *G07F 17/3244* (2013.01); *G07F 17/3295* (2013.01)

(58) Field of Classification Search
None
See application file for complete search history.

(56) References Cited

U.S. PATENT DOCUMENTS

| | | | |
|---|---|---|---|
| 6,050,895 | A | 4/2000 | Luciano, Jr. et al. |
| 6,334,614 | B1 | 1/2002 | Breeding |
| 7,682,239 | B2 | 3/2010 | Friedman et al. |
| 7,931,531 | B2 | 4/2011 | Oberberger |
| 8,162,742 | B2 | 4/2012 | Oberberger |
| 9,098,974 | B2 | 8/2015 | Mayeroff et al. |
| 9,159,202 | B2 | 10/2015 | De Waal et al. |
| 9,251,666 | B2 | 2/2016 | Oberberger |
| 9,440,152 | B2 | 9/2016 | Thompson et al. |
| 9,542,799 | B2 | 1/2017 | Washington et al. |
| 9,875,499 | B2 | 1/2018 | Washington et al. |
| 9,940,785 | B2 | 4/2018 | Washington et al. |
| 10,242,539 | B2 | 3/2019 | Oberberger |

(Continued)

OTHER PUBLICATIONS

Synergy Blue, LLC; Provisional U.S. Appl. No. 62/127,821, Entitled: RPG and Sports Themed Hybrid Arcade-Type, Wager-Based Gaming Techniques; Mar. 3, 2015; 96 pages; US.

(Continued)

*Primary Examiner* — Lawrence S Galka
(74) *Attorney, Agent, or Firm* — Resolute Legal PLLC

(57) ABSTRACT

Embodiments of the invention provide A system includes a game device. A first game including a transition point is conducted on the game device. When a transition point is reached, a second game outcome is selected. The second game outcome is generated by a second game that is logically independent of the first game. The second game outcome generated by the second game is independent of the first game.

15 Claims, 3 Drawing Sheets

(56) References Cited

U.S. PATENT DOCUMENTS

| | | | | |
|---|---|---|---|---|
| 2004/0116173 | A1 | 6/2004 | Baerlocher | |
| 2005/0239538 | A1 | 10/2005 | Dixon | |
| 2008/0009344 | A1* | 1/2008 | Graham | G07F 17/3244 463/25 |
| 2009/0061998 | A1 | 3/2009 | Popovich et al. | |
| 2009/0117974 | A1 | 5/2009 | Hornik | |
| 2011/0183739 | A1 | 7/2011 | Ansari | |
| 2012/0208623 | A1 | 8/2012 | Friedman et al. | |
| 2015/0187184 | A1* | 7/2015 | De Waal | G07F 17/3286 463/20 |
| 2015/0206393 | A1 | 7/2015 | Hoffman et al. | |
| 2015/0375117 | A1 | 12/2015 | Thompson et al. | |
| 2016/0171835 | A1 | 6/2016 | Washington et al. | |
| 2017/0124812 | A1 | 5/2017 | Washington et al. | |

OTHER PUBLICATIONS

Synergy Blue, LLC; Provisional U.S. Appl. No. 62/091,451, Entitled: Hybrid Arcade-Type, Wager-Based Gaming Techniques; Dec. 12, 2014; 67 pages; US.

PCT International Search Report and Written Opinion dated May 11, 2020, International Application No. PCT/US2020/018733, pp. 1-15.

* cited by examiner

HYBRID WAGERING AND SKILL-BASED GAMING SYSTEM AND SERVER

RELATED APPLICATIONS

This application is a continuation-in-part of U.S. application Ser. No. 14/793,549 filed on Jul. 7, 2015, the entire contents of which are incorporated herein by reference.

FIELD OF THE INVENTION

Some embodiments of the invention relate to systems, servers, methods, and devices for computing providing enhanced functionality over the prior art. More specifically, some embodiments of the invention relate to systems, servers, methods and devices for managing gaming on a computing device, such as an electronic gaming device.

BACKGROUND OF THE INVENTION

The word "gaming" typically refers to two different concepts in the entertainment industry. In one context, sometimes referred to as entertainment gaming, gaming refers to computer or video games in which play is conducted from a gaming console, arcade machine, personal computer, cellular telephone, personal digital assistant ("PDA"), or the like. In entertainment gaming, the player usually exercises skill, logic, and strategy to influence the outcome of the game which may also be impacted by luck. Games within the entertainment gaming genre may take many different forms, including games for individuals to compete against a computer-controlled opponent (or a standard, such as a game timer or minimum score), games for individuals to compete against other individuals, games for teams to compete against other teams, or the like. While some games involve some payment, the payment is not a "wager." That is, entertainment games usually require a payment for the purchase or license of the game and/or a payment to play the game in a specific forum, such as specially designated networks or the like. However, such a payment is not in the form of a wager since the payment is typically not staked for participation in the game, and typically is not used to determine eligibility for a tangible prize.

Entertainment games may be conducted in single player or multi-player environments with each player playing the game at a separate terminal, such as a personal computer, that communicates with a server coordinating the game. Massively multi-player online games ("MMOG") such as World of Warcraft® and EverQuest® are examples of games with multi-player play, and the enormously popular game Fortnite® is an example of a massively multiplayer online role-playing game (also known as an "MMOFPS" and a Battle Royale Game ("BRG".) Real time simulation ("RTS") games such as Farmville® and Mafia Wars™ are examples of games with multi-player social interaction. The advent of social networking websites, such as Facebook®, has drawn even more players to games with multi-player play and/or multi-player social interaction. World of Warcraft® is a registered trademark of Blizzard Entertainment, Inc. of Irvine, Calif. EverQuest® is a registered trademark of Daybreak Game Company, LLC of San Diego, Calif. Fortnite® is a registered trademark of Epic Games, Inc. of Cary, N.C. Farmville® is a registered trademark of Zynga Inc. of San Francisco, Calif. Mafia Wars™ is a registered trademark of Zynga Inc. of San Francisco, Calif. Facebook® is a registered trademark of Facebook, Inc. of Menlo Park, Calif.

Many of these entertainment games include elements of skill, strategy, or other player interaction which influences the outcome of the game. The outcome of the entertainment game typically includes a score, level, achievement, or the like, which is usually non-tangible in that it has no value other than bragging rights.

The word "gaming" may also be used to refer to wagering games and gambling games. Regardless of whether the gaming occurs in a physical, brick-and-mortar casino or a virtual, online casino, these types of casino or wagering games usually include three components: a wager, chance, and a reward. That is, casino or wagering games are usually games in which the outcome of a wager ("the reward") is determined by chance, which predominates over every other factor, including skill. For example, chance predominates in card games such as poker, blackjack, or the like, even though some skill is involved. Specifically, chance, rather than the player's skill, determines which cards are dealt to the players, which cards are dealt to a dealer, if any, which cards are cut from the deck or shoe of cards, and so forth. In other wagering games, such as reel slot games, numbers games (such as keno, lotto, pull tabs, or the like), dice games, wheel games (such as roulette), or the like, chance is the only factor to determine the outcome of the wagering game, with skill having no influence on the symbols or numbers drawn, rolled, or spun.

The outcomes of wagering games can usually be determined by the probabilities that govern the games and, therefore, the hold for the game operator over the long term can be predicted. Predicting the game operator hold may not be true for skill games, in which the outcomes vary from player to player based on the player's skill. Wagering games must be operated for a profit over the long term and casinos would generally not operate games that allow certain players to improve their performance through practice. Consequently, casinos will not, and in some jurisdictions, cannot offer gambling games in which skill predominates (or even affects) the determination of the outcome of the gambling game.

A well-known consequence of the difference between skill games and chance games is the way in which casinos offer poker games versus how casinos offer house banked games. As may be appreciated, poker, in which skill plays a factor, is typically offered only in a player-banked or pari-mutuel form. In online poker and other player-banked games, massive volumes of players are required to maintain liquidity.

In a player-banked game, a player-banker banks the other players' wagers and in a pari-mutuel game, the players contribute to a pot that is awarded to the winning player(s). While player-banked and pari-mutuel games are more predictable in the short term because the casino operator does not collect losing wagers and pay winning wagers, the casino operator only collects a small fee for administering and operating the game. This fee is levied regardless of the outcome of the game, so the casino operator makes money on every game. However, because the fee is generally low, the casino operator must generally have a high volume of play to be profitable. For example, because the online casino only makes a small, scaled commission fee (also known as a "rake") on each poker game, the online casino must ensure that a large volume of players, and hence a large volume of pots to rake, are processed by the site.

Conversely, house-banked games, i.e., those games in which the online casino operator banks wagers by collecting losing wagers and paying winning wagers, are particularly profitable for casinos because the games include a built-in house edge that guarantees the game will be profitable in the long term. However, the win or loss from these games can fluctuate wildly in the short term, such as when a player has a winning streak, and the casino operator must maintain a reserve of cash to pay off all winning bets.

SUMMARY OF THE INVENTION

Some embodiments include a machine, comprising a non-transitory computer readable medium including program logic instructions. Some embodiments include a game device interface configured and arranged to detect an input associated with a monetary value.

Some embodiments include a game device controller in communication with the game device interface, the non-transitory computer readable medium, and at least one of a software and hardware-based random number generator, wherein the game device controller is configured to communicate to a game device display of the game device interface, and is operative to execute the program logic instructions comprising: receiving a fee through the game device interface from the input, the fee being greater than zero.

Some embodiments include conducting a first game by the game device controller and receiving player input data, wherein the first game includes transmission of data identifying at least one transition point. Some embodiments include generating a first game outcome based, at least in part, on the player input data. Some embodiments include conducting a second game, which is logically independent of the first game, by the game device controller solely in response to the first game reaching the transition point, wherein the second game utilizes the random number generator module to generate a gambling game outcome independent of the first game and the player input data.

Some embodiments include determining by the game device controller whether the second game outcome is a winning outcome. Some embodiments include issuing a payout through a payout device of the game device interface when the second game outcome is a winning outcome independent of the conduct of the first game. Some embodiments include independent of the outcome of the first game and/or the second game, returning at least a portion of the fee.

In some embodiments the fee comprises a game fee and a wager. In some embodiments the returned fee comprises at least a portion of the game fee. In some embodiments said step of determining whether the second game outcome is a winning outcome comprises comparing the second game outcome to a predefined schedule of winning outcomes by said game device controller. Further, in some embodiments said program instructions further comprise conducting said first game in response to receipt of said game fee and returning at least a portion of said game fee at said transition point.

In some embodiments said program instructions further comprise issuing an award based on said game fee and said first game outcome. In some embodiments said program instructions further comprise: displaying said first game at said game device display while conducting said first game. Some embodiments include conducting said second game without displaying said second game at said game device display.

Some embodiments include an electronic game machine, comprising: a non-transitory computer readable medium including program logic instructions. Some embodiments include a game device interface configured and arranged to detect an input associated with a monetary value and at least one event feed.

Some embodiments include a game device controller in communication with the game device interface, the non-transitory computer readable medium, and at least one of a software and hardware-based random number generator, wherein the game device controller is configured to communicate to a game device display of the game device interface, and is operative to execute the program logic instructions comprising: receiving a wager and a game fee through the game device interface from the input, the game fee being greater than zero.

Some embodiments include conducting a first game by the game device controller and receiving player input data, wherein the first game includes transmission of data identifying at least one transition point. Some embodiments include generating a first game outcome based, at least in part, on the player input data.

Some embodiments include conducting a second game, which is logically independent of the first game, by the game device controller solely in response to the first game reaching the transition point, wherein the second game utilizes the random number generator module to generate a gambling game outcome independent of the first game and the player input data. Some embodiments include determining by the game device controller whether the second game outcome is a winning outcome.

Some embodiments include issuing a payout based on the wager through a payout device of the game device interface when the second game outcome is a winning outcome independent of the conduct of the first game. Some embodiments include independent of the outcome of the first game and/or the second game, returning at least a portion of the game fee.

In some embodiments the game device controller is operative to execute the program instructions comprising detecting and displaying the at least one live or real event feed on the game device display. In some embodiments the player input data comprises or is related to an outcome from the at least one live or real event feed based on an outcome, status, or stage of the live or real event and the player's input to the game device controller related to the at least one live or real event feed. In some embodiments the player's input comprises a skill-based input.

DETAILED DESCRIPTION

Figure 1:
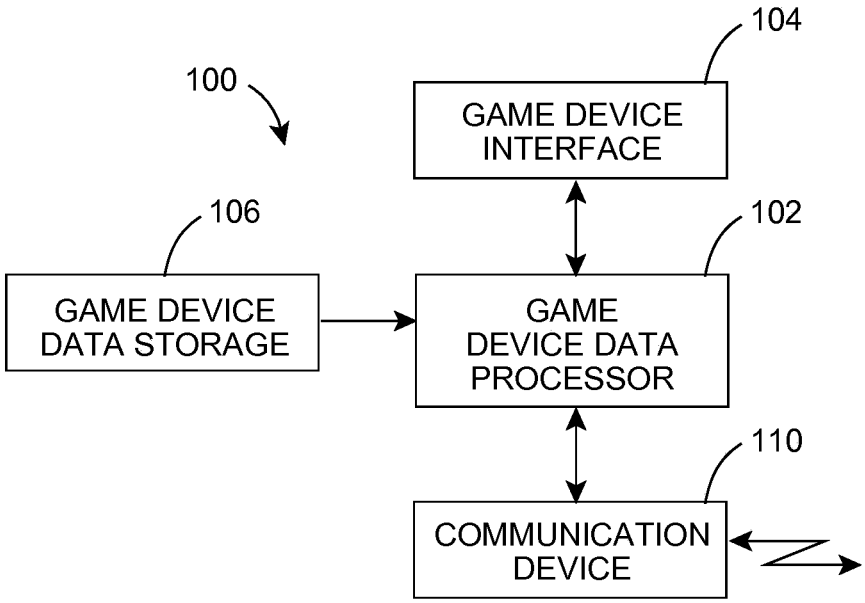
FIG. 1 is a block diagram of a game device according to an embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Reference is now made to the figures wherein like parts are referred to by like numerals. Referring to FIGS. 1-4, an embodiment of the invention includes a system, server and method for linking activity in a first game to the triggering of at least a portion of a second game. In some embodiments, the first game can comprise a non-gambling (also referred to as a skills-based) game, and the second game can comprise a gambling game. In some embodiments, either the first and/or the second game can comprise a plurality of games. In some embodiments, either the first and/or the second game can comprise a sequence of one or more games. In some embodiments, either the first game and/or the second game can comprise multiple segments of a single game or multiple, separate games.

In some embodiments, at least one embodiment of the invention may be applied to any first game (non-gambling game) and a different, logically independent, second game (gambling game). That is, some embodiments of the invention described herein are not dependent on the specific non-gambling game and gambling game(s) involved. Thus, in some embodiments, a non-gambling game may take any form including any pay-to-play, free-to-play, free-to-download, fee-to-download, or any combination thereof. Similarly, in some embodiments, the second game can be conducted in any format. For example, in various embodiments of the invention, one or more aspects of the invention can be applied to any wagering game in which a wager is staked for a chance to win an award, whether that wager is in the form of real money, game credits, subscription fees, or the like, and any combination thereof.

In some embodiments of the invention, the first game can comprise a game in which no wager is staked although, as previously noted, it is contemplated that in some embodiments, the non-wagering game may be free, require a subscription or fee, or require other consideration for play (e.g., joining a loyalty program, submitting data used for marketing, making a purchase, or the like). Further, it is also noted that although no wager is staked in the non-wagering game, prizes, whether tangible (such as a good, service, currency, or the like) or promotional (discounts, play currency, or the like) in nature may be offered as awards in the non-wagering game. Additionally, in some embodiments of the invention, the non-wagering game can include a virtual economy in which real and/or virtual money can be used or exchanged for in-game thematic or game play elements. For example, in some embodiments, role playing games such as World of Warcraft® and Club Penguin® have virtual economies in which in-game thematic or game play elements can be purchased by a user using in-game credits. In some embodiments, any of the virtual money can be converted to real currency for delivery to the player. For example, in some embodiments, a player can get paid $5,000 in virtual money, which equals $50 in real money. In some embodiments, players points that consist of real money value may shift to a higher or lower dollar value. In some embodiments a player may select and/or change a denomination at any time. Club Penguin® is a registered trademark of Disney Canada Inc. of Kelowna, British Columbia, Canada.

In the non-limiting examples below, the first game may take the form of a game, puzzle, quiz, or other activity. For example, in some embodiments, the first game may be a puzzle (such as a jigsaw puzzle, crossword puzzle, chess puzzle, or the like), magic number square (such as Sudoku), arcade or video game (such as Call of Duty® or Fortnite®), social game (such as Farmville®), role playing game (such as World of Warcraft®), RPG, MMORPG, MMOFPS, FPS, RTS, MOBA, BRG, logic games, trivia games, simulation game, action games, platform games, artillery games, fighting games, racing games, on-rail games, survival games, survival horror, casual games, mobile games and the like. Call of Duty® is a registered trademark of Activision, Inc., of Santa Monica, Calif.

In some embodiments, a game device 100 can take any form, including, but not limited to, a mobile telephone or smart phone, a tablet device, a personal digital assistant ("PDA"), a personal computer, a kiosk, an arcade game machine, a game console, a handheld device, an electronic gaming machine, interactive television, or any other electronic device. In some embodiments, the game device 100 can include a game device data processor 102 in communication with a game device interface 104 and a game device data storage 106. In some embodiments, the game device interface 104 can include an output device, such as a display, and an input device. Optionally, in some embodiments of the invention, the output device and input device can be combined, such as in a touch screen or other electronic user interface. In at least one embodiment, the game device 100 can include a communication device 108 that includes at least a transmitter and/or a receiver.

In some embodiments, the form of the game device 100 can vary depending on the implementation. In this regard, a system according to some embodiments of the invention can include a plurality of game devices 100 in mixed forms. Although the non-limiting examples below reference game devices 100 as primarily casino devices, such as electronic gaming machines, live and electronic gaming tables, electronic and mechanical slot machines, or the like, in some embodiments, many different forms or combinations of forms of game devices 100 can be included within a system, such as mobile phones or smart phone, tablets, personal computers, or the like.

In some embodiments, the game device data processor 102 can take any form including a conventional microprocessor. In some embodiments, a game device data processor 102 can include a random number generator module in the form of hardware or firmware, or can execute a random number generator in the form of software. In embodiments where the game device data processor 102 uses a random number generator module, in some embodiments, the random number generator module can, at least in part, generate a number in random or quasi-random fashion which, in turn, can be used, at least in part, to produce a random second game outcome. In alternate embodiments, the random number generator module can generate random outcomes through a central determination module (such as a Bingo draw in Class II gaming devices or a lottery draw), historical racing data, or the like. In another embodiment, a system can include a server 200 which contains a random number generator in the form of hardware or firmware, or executes a random number generator program in the form of software. In some embodiments, the server 200 can communicate the randomly generated number, or the random second game outcome mapped to the randomly generated number, to the game device 100 for display thereon. In some further embodiments of the invention, a plurality of random number generators can be used. Additionally, in some embodiments, one or more random number generators can select one or more probability maps, lookup tables and the like, and such selection can be based on one or more factors including, without limitation, player skill and/or certain transition points and/or thresholds attained.

In at least one embodiment, the first game and/or the second game can take the form of a software application and/or application programming interface ("API") that is executed and displayed on a game device 100. Alternatively, in some further embodiments, the games can take the form of a software application and/or application programming interface ("API") that is stored on the server 200 and executed and/or displayed remotely at a game device 100. In some embodiments, a game device 100 can be configured to execute a first game. For example, in some embodiments, the game device 100 can be an electronic gaming machine, and a first game can be software that is installed on the game device 100. In various embodiments, the first game can include a fee or can be free, but in either case, would not require a wager. However, in such embodiments, a fee for the first can be collected along with a wager for the second game (as described in greater detail below), although the fee and wager can be handled separately.

In some embodiments, the game device interface 104 can include one or more displays, such as a cathode ray tube ("CRT") monitor, liquid crystal display ("LCD"), organic light emitting diode ("OLED") display, plasma display, television, or the like. In some embodiments, the game device data processor 102 can communicate directly or indirectly, such as through a video controller or video card, with the display of the game device interface 104.

In some embodiments, the game device interface 104 can include an input device to receive input from one or more users and transmit it to the game device data processor 102. In some embodiments, such an input device can take any form, such as mouse, pointer, keyboard, keypad, button panel, stylus, voice recognition hardware or software, handwriting recognition hardware or software, or the like. In further embodiments, the input device can be integrated with a display in a touch screen device.

In some embodiments of the invention, a game device interface 104 can include a device to receive wagers and/or purchases of game credits. In some embodiments, this can include a physical device. For example, in some embodiments, a game device interface 104 and/or game device interface 204 can include a ticket or voucher reader, bill acceptor, coin receiver, magnetic-stripe card reader, smart card reader, bar code scanner, radio frequency identification ("RFID") transceiver, radio wave receiver, transmitter, and/or transceiver (such as WiFi®, Bluetooth®, cellular, or the like), or any combination thereof. WiFi® is a registered trademark of Wi-Fi Alliance of Austin, Tex. Bluetooth® is a registered trademark of Bluetooth Sig, Inc. of Kirkland, Wash.

In some further embodiments of the invention, the game device interface 104 can include an output device to output currency or representations of currency for awards, cash out requests, or the like. For example, in some embodiments, the output device could include a ticket or voucher printer, bill or coin dispenser, card encoder, bar code printer, RFID transceiver, radio wave receiver, transmitter, and/or transceiver, or the like. It is noted that, in some embodiments, devices can perform multiple functions, such as reading tickets or vouchers and accepting bills.

Figure 2:
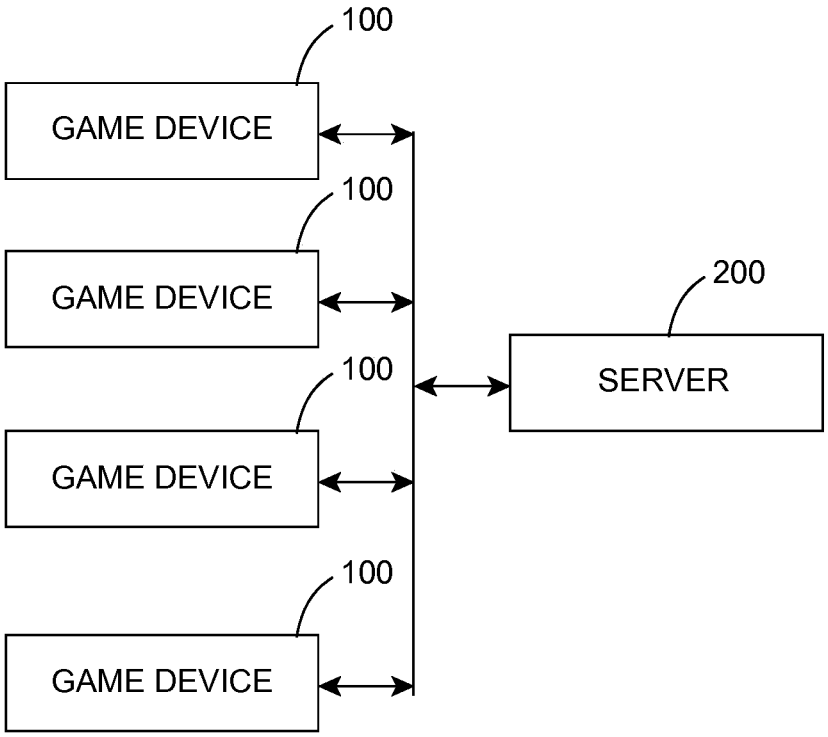
FIG. 2 is a block diagram of a system according to an embodiment of the invention.
Figure 3:
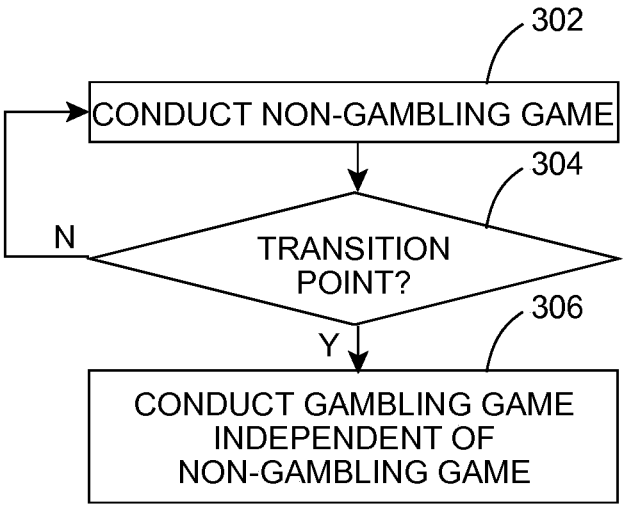
FIG. 3 is a flowchart of a method according to an embodiment of the invention.

Some embodiments include a communication device 110 that can take any form, including a modem, wired or wireless network interface card ("NIC"), or the like. Likewise, in some embodiments, a communication device can use any communication method including wired or wireless signals, radio waves, light, laser, sound, image, or the like, and can communicate using any protocol, including TCP/IP, serial communication, cellular, Bluetooth®, or the like. As illustrated in FIG. 2, in some embodiments, a system can include a server 200 which is in communication with the game device 100. In some embodiments, the server 200 can communicate with the game device 100 via a communication device 110 at the game device 100. It some embodiments, server 200 can store and execute software to produce displays at the game device 100, including by operating a random number generator at the server 200 to thereby remove the necessity for the game device 100 to include a random number generator. As may be understood, in some embodiments, the server 200 can also serve to provide additional processing capacity, storage, tracking, and display for information received from game devices 100, and can likewise provide a pathway for communication among multiple networked game devices 100.

In other embodiments, the game device data storage 106 can take any non-transitory form including magnetic storage, optical storage, flash storage, or the like. Some embodiments include a game device data storage device 106 that can store executable program instructions executable by the game device data processors 102. For example, some embodiments include a game device data storage 106 that can store executable program instructions to conduct a first game, along with executable program instructions to produce graphics, sounds, social media content, and game parameters for conducting the first game. Likewise, in some embodiments, the game device data storage 106 can store executable program instructions to conduct a second game, along with executable program instructions to produce graphics, sounds, pay tables, and game parameters for conducting the second game. As suggested above, in some further embodiments, a game device data storage device 106 can also store executable program instructions to generate a random number. The use of a random number combined with an interface that receives wagers and issues payouts would satisfy most legal definitions of a wagering game, game device, second device, or similar term.

In some embodiments of the invention, the game device data storage device 106 can be local to the game device 100, remote from the game device 100, or both. For example, in some embodiments, one or more game applications for either or both of the first game and/or the second game can be executed from a "cloud" of remote data storage devices 106 in communication with the game device 100 via a network or other means of communication. In some embodiments, the game device 100 can, in such a cloud embodiment, communicate with the application layer (e.g., such as an API) storing the first game and/or game on a continuous or periodic basis. That is, in some embodiments, a game device 100 can execute a first game and/or second game by maintaining a substantially continuous or intermittent connection to the application layer of a cloud such that the first game and/or second game are not stored locally at a game device 100. Alternatively, in some further embodiments, a local game device 100, and remote game device 100, or both, can download from the application layer of a cloud some or all the files necessary to execute a first game and/or game such that the first game and/or game are executed at least partially in a local computing environment.

As noted above, in an alternative embodiment, a system can include a server 200. It is noted that in some embodiments, the inclusion of a server 200 can be entirely optional, as certain embodiments omit a server 200, and certain functions within a system including a server 200 would not require use of a server 200. In those embodiments utilizing a server 200, the server 200 can be configured to perform many different functions, including, but not limited to, providing an interface, or interfacing, with a website, such as a social media website, to display and provide access to data and information gathered (whether automatically or upon receipt of a user command) from a game device 100. In some further embodiments, the server 200 can also provide tracking and reward functions by storing information gathered from, or input by users at, a game device 100. For example, in at least one embodiment, a server 200 can be configured to store user tracking records that store data representing each user's use of a game device 100. In some embodiments, other activity can be tracked as well. For example, in some embodiments, the tracking performed by the server 200 can be integrated with other forms of purchase tracking, activity tracking, or the like. For example, in some embodiments, where the game device 100 is an electronic gaming machine, activity can be tracked for a user's activity at the gaming machine for purposes of rating the player in a player loyalty/reward program. In another embodiment, a server 200 can perform player loyalty and/or player reward functions in which player units (sometimes referred to as "player points"), can be awarded based on the user activity tracked at the game device 100 in either or both of the first game and the second game.

In another embodiment, a server 200 can also perform financial functions. For example, in some embodiments, the server 200 can process, or communicate with a device that processes, financial information for the purpose of performing purchases, wagers, or the like.

In some embodiments of the invention, the first game can include one or more transition points in the game play. It is noted that, as used herein, a transition point is not necessarily tied to the end of the first game. Rather, in some embodiments, the transition point can occur at any time during the first game, including at any point at the beginning, middle, or end of the first game, or at any times or points in-between. Further, some embodiments can include multiple first games, or multiple levels within a first game can be required to reach a transition point. For example, in some embodiments, a transition point can be reached by a player striking a specified target in three consecutive first games, successfully completing five levels in a first game, finding a specified number of items over one or more first game levels, or the like. Similarly, in some embodiments, a first game can have multiple transition points.

Referring to FIGS. 1-4, some embodiments include a method in which activity at a game device 100 during the conduct of at least one first game can result in a transition point which triggers at least a second game at the game device 100. Some embodiments include a method in which activity at a game device 100 during the conduct of a first game can result in a transition point which triggers a second game at the game device 100. Generally stated, in some embodiments, the conduct of a first game can include player input. In further embodiments, the player input can require some skill, such as striking a target. In some embodiments, based on the player input, a determination is made whether a transition point has been reached in the first game. In some embodiments, if a transition point has occurred, a second game can be conducted and a second game outcome can be generated. In some embodiments, the second game outcome can be entirely dependent on a random number generator, and entirely independent of the first game. Understood in this manner, in some embodiments, the first game can be a stage that triggers the second game, without influencing or interacting with the second game.

In some embodiments, the first game can be conducted 302 for a user at the game device 100. As noted above, in some embodiments, the first game can be skill-based, chance-based, or a combination thereof. In another embodiment, the first game can be skill-based or predominated by skill, and conduct of the game can include receipt of skill-based player input at the game device 100. As discussed above, the first game can include video games, puzzles, trivia, or other forms of skill-based games in some embodiments. For example, in at least one embodiment, the first game can be a conventional video game that includes levels through which the player advances during the course of the game.

In at least one embodiment, the first game can include in-game purchases. In some embodiments, in-game purchases, such as items, upgrades, levels, character attributes, "power-ups," or the like, can be made through the game device 100. In at least one embodiment, such purchases can be tracked and metered as a sale on a "spend meter" that is separate from any meter(s) for fees and/or wagers for playing the game (as discussed in greater detail below). In an alternate embodiment, purchases can be tracked on a meter for fees collected (and possibly returned) for play of the first game (as discussed in greater detail below). In yet another embodiment, purchases can be tracked (and paid for) using winnings from a second game (as discussed in greater detail below). In some embodiments, such tracking can be performed by meters which always "uptick" (positively increment). Fees, returned fees and other items of value, regardless of form, can also be tracked by such metering and a player can receive real or virtual currency or awards at one or more desired times. Such currency and award receipt can be dependent on, or independent from, skill points leaderboard position, and the like.

In some embodiments of the invention, in-game purchases can be paid for using "skill points" earned in the first game. In at least one embodiment, "skill points" can be awarded based on the play of the first game. For example, in some embodiments, "skill points" can be awarded based on the skill with which the first game is played using such things as accuracy, and/or speed, and/or time, and/or other objective measurements of the play of the first game. In another embodiment, "skill points" can be awarded based on time on device, and/or spend (e.g., wagers and/or fees), and/or number of activations, and/or number of transition points, or the like. In yet another embodiment, "skill points" can be awarded based on winnings in the second game and/or fees returned in the first game, or the like.

Additionally, or alternatively, in some embodiments, "skill points" can be converted into money, credits, or the equivalent of money or credits, for play of the first game. That is, in some embodiments where a fee is assessed for play of the first game and/or a wager is assessed for play of the second game (as discussed in greater detail below), skill points can be converted into money, credits, or the equivalent thereof, that can be used to pay for fees and/or wagers. In at least one embodiment, such "skill points" can be carried over (such as through a player account stored in a local, server, or cloud-based database) across sessions or, alternatively, can be forfeited at the end of play. Similarly, in some embodiments, "skill points" can be non-cashable, i.e., can be used for game play but not converted into cash, or can be cashable, i.e., can be cashed out of the game device 100. In some embodiments, skill points can, or may not, be gifted to another player. In some embodiments, the first game can always return positively, and the compensation can be tax free in some embodiments as well.

In other embodiments, upgrades, levels, items, character attributes, cosmetic attributes, power-ups, or the like can be earned through play of the first game. That is, in some embodiments, the satisfaction of certain conditions can be associated with upgrades, completion of levels, leveling up, obtaining in-game items, altering character attributes, powering up, or the like. In some embodiments, such upgrades, levels, items, character attributes, power-ups, or the like may, or may not, be gifted to other players.

As discussed above, in some embodiments, the first game can include at least one transition point. In some embodiments of the invention, while conducting the first game, the game device 100 can determine whether a transition point has been reached. As noted above, in some embodiments, the transition point can take any form. For example, in some embodiments, the transition point can be reached by performing a task within the first game, reaching a goal within the first game, or otherwise achieving some level of performance within the first game. In a further or alternative embodiment, transition points (or the opportunity to reach a transition point) can be obtained, at least in part, randomly. For example, in some embodiments, within a video game, a transition point can include finding and obtaining a dynamic item that appears sometimes, but not all the time, with the appearance of the item determined by chance. In another embodiment, concepts such as leveling, collecting, filling meters, or the like can be incorporated into the first game. In one further embodiment, transition points can be coincident with reaching new levels, completing a collection, filling a meter, or the like. Additionally, or alternatively, in some embodiments, transition points can occur independent of reaching new levels, completing a collection, filling a meter, or the like. In other embodiments, time can be introduced as a component into the first game. As may be appreciated, in some embodiments, time can be used as a measure of performance (e.g., time to finish a race, time to complete a task, or the like), and/or can be used as a deadline to create a sense of urgency (e.g., collect as many objects as possible in two minutes).

In another embodiment, transition points can be dynamic in the game. For example, in at least one embodiment, the appearance of certain transition points (or the likelihood of certain transition points appearing) can be based on the conduct of the first game. For example, in some embodiments, the time on the game device 100, and/or number of plays of the first game, and/or number of transition points reached, and/or the skill of the player (as measured objectively through play of the first game), or the like can influence the appearance of certain transition points. Thus, in one such example directed to a shooting game, certain targets such as a spaceship, can appear dynamically based on play of the first game (e.g., after a certain period of time playing the first game, after a quantity of other targets have been shot, after a certain skill level has been attained, or the like).

In an alternate embodiment of the invention, the likelihood of certain transition points appearing can be variable, but independent of the conduct of the first game. For example, in a shooting game, certain targets (i.e., transition points) can have a 10% chance of appearing in a stage. Thus, over the long run, those targets will tend to appear in 10% of the stages while not appearing in 90% of the stages.

In some further embodiments, a prize can be awarded for reaching or attaining certain transition points in the first game. In at least one embodiment, the prize can be awarded based on skill rather than chance. That is, in some embodiments, certain transition points can result in a prize in addition to triggering the second game (as described in greater detail below). Referring to an example directed to a shooting game, striking a target (i.e., reaching the transition point associated with the target) can result in a prize independent of the outcome of the second game triggered by striking the target. In some embodiments, the prize can be fixed, e.g., 50 credits, $10, or the like, or variable, e.g., randomly determined.

Alternatively, in some further embodiments, the prize can be progressive in that it builds over time until all or a portion of it is awarded. For example, in at least one embodiment, a progressive pool can be funded by allocating a portion of a fee (described in greater detail below) assessed for conduct of the non-wagering game to the progressive pool. In some embodiments, the progressive pool may award a player a percentage of the pool. In some embodiments, when the transition point is successfully attained, the progressive pool is awarded. In some embodiments, "success" can be defined in any manner, e.g., speed, and/or elapsed time, and/or accuracy, and/or quantity, or any other measure through which the transition point is encountered. In some embodiments, the progressive pool can be tracked by the game device 100 itself, through a server or jackpot controller communicating with the game device, manually, or in any other manner. The prize or pool can comprise operator seeding and/or a single game does not need to fund its own game—multiple games can fund the pool or the pool can be a universal pool or can be completely independent. In some embodiments, a casino pool can be used.

In some additional or alternative embodiments, certain prizes can be associated with a sequence or combination of transition points reached. Again, in some embodiments, such prizes can be independent of the second games triggered by the transition points. Rather, the prize is strictly based on the first game. For example, in some embodiments, if, in the course of playing the first game, three specific transition points are successfully attained in a specific sequence or combination, a prize can be awarded by the first game. Again, in some embodiments, the prize can be fixed, variable, or progressive. Likewise, in some further embodiments, the combinations of transition points that result in such prizes can be fixed, variable, and/or random. As may be appreciated, skill prizes can be funded in any manner including an allocation of at least some of the fees assessed for play of the first game (as described above), through an allocation of wagers assessed for play of the second game, through altering the math model of the second game(s) associated with the transition point associated with the skill prize, or the like.

In yet additional or alternate embodiments, attaining combinations of transition points can create a transition point. For example, in a shooting game, in some embodiments, striking targets A, B, and C within five seconds can satisfy a transition point such that four transition points (and four second games) occur within the sequence. That is, in some embodiments, striking target A can trigger a first gambling game, striking target B can trigger a second gambling game, striking target C can trigger a third gambling game, and striking the combination of targets A, B, and C within five seconds can trigger a fourth gambling game.

In some embodiments of the invention, the first game can include some elements of skill to play the game, the process of reaching transition points can be defined to include no skill at all. That is, in some embodiments, any skill required to progress through the first game can be separate from the process of reaching transition points which, in one optional embodiment, requires no skill at all. For example, in embodiments where the first game is a shooting game, the transition point can be reached by merely pulling a trigger, regardless of whether a designated target within the first game is struck. In such an example, the trigger can be viewed as replacing the handle or "spin" button on a traditional reel slot machine. In some embodiments, faster trigger pulls would merely cause the first game to reach transition points faster and result in faster gambling, i.e., each trigger pull would result in the placement of a wager, display of an event in the first game, conduct of the second game, and resolution of the wager.

In another embodiment, the skill of the player can be partially or fully negated by altering the transition point to accommodate the player. For example, in another embodiment directed to a first game which is a shooting game, the area for which a "hit" is registered in the first game, thereby triggering a transition point which causes the second game to be conducted, can grow when one or more "misses" occur so that a "hit" becomes more likely. In another embodiment, such a process can be repeated so that the target area occupies the entire display, thereby guaranteeing a "hit" which, in turn, guarantees that a transition point will be reached regardless of the player's skill level.

In some embodiments, a first game can include solo transition points, group transition points, or both solo and group transition points. Thus, in at least one embodiment, the first game can be a multi-player game. In other embodiments in which the first game is a multi-player game, the players can cooperate, compete, or a combination thereof to reach transition points. In at least one embodiment, transition points can require the assistance or participation by other users. For example, in at least one embodiment, the first game is a social game in which at least a portion of the game play includes social interaction with other users. In at least one embodiment, the assistance of, or participation by, other users can be required to reach the transition point. For example, in some embodiments, different players can be provided with different tools or weapons, and a transition point can only be reached by forming a team with all the required tools or weapons to bypass the obstacles blocking the pathway to the transition point.

In additional or alternate embodiments, players can compete against one another to reach transition points. For example, in at least one embodiment, players can challenge one another. The result of the challenge can constitute or relate to a player reaching a transition point, e.g., a transition point can be reached when a player wins (or loses) a predetermined type or quantity of challenges.

In another embodiment, players can cooperate. In at least one embodiment, one or more transition points can be tasks that can only be performed when two or more players in the multi-player game cooperate, e.g., at least some transition points can be impossible to reach without the cooperation, communication, assistance, or other participation of another player in the first game. In some embodiments, such cooperative participation can be simultaneous, e.g., such as a task of reaching an object that cannot be reached by either player alone, sequential, e.g., such as a task of one player finding an object then telling another player how to retrieve it, a combination of simultaneous and sequential cooperation, or time-independent.

In a further embodiment, the task can require cooperative, yet competitive, participation by multiple players. For example, in some embodiments, a task of demolishing a building can require multiple players to accomplish, but if only one of the players can reach the transition point, the players can compete, for example, to fire the final shot that demolishes the building.

In some embodiments that include cooperative play, multiple game devices 100 can share a single display or group of displays. For example, in some embodiments, a "team" of players can each assigned a game device 100, but the game devices 100 all communicate with a single, large format display. In some embodiments, while conducting the first game, player activity for all the game devices can be displayed on the shared display.

In another embodiment, a task can require cooperation, but the cooperation may not necessarily be coordinated. For example, in some embodiments, a task can require players to solve a puzzle with separate players solving separate pieces of the puzzle so that a player is only responsible for his or her puzzle segment and is neither helped nor hindered by other players. It is noted that in such an optional embodiment, time may not be a factor insofar as the puzzle segments can occur simultaneously, sequentially, or independent of time (e.g., each player solves a segment as it is encountered in the game).

In another embodiment, the first game can involve some physical or purely mental activity. For example, some embodiments can include hitting a golf ball or baseball, shooting a basketball, throwing darts, or other physical activity can be a component of the first game. In some embodiments, the physical activity can be sensed by the game device conducting the first game through any means, including a pressure pad, and/or physical sensors, and/or electromagnetic sensors (e.g., using infrared, and/or light, and/or ultrasound, and/or microwave, and/or radar, or other electromagnetic radiation), and/or optical sensors, or the like. As above, in some embodiments, a first game involving physical activity can include a transition point that is reached through the physical activity.

In any of the embodiments described above, reaching a transition point may not necessarily be a final outcome. Rather, a transition point can occur during a first game. Additionally, in some embodiments, a transition point is not necessarily a "winning" outcome or a "losing" outcome, although it could be tied to either a winning outcome or a losing outcome, and can be independent of winning or losing the first game. For example, in some embodiments, a user can reach a transition point for completing a task or finding an item within a first game, regardless of whether the end result of the first game is a "win" or a "loss." In another embodiment, the transition point can be specifically tied to one or more wins or losses.

In some embodiments, when a transition point is reached 304 during the first game, a second game can be triggered. In at least one embodiment, the second game can be initiated immediately at the same game device 100. In some further embodiments, the initiation of the second game can be caused directly by reaching the transition point in the first game or, alternatively, a signal can be generated when a transition point is received, and the second game can be initiated in response to the signal. In another embodiment, the transition between the first game and the second game can occur by replacing the display of the first game with the display of the second game. In some embodiments, the display replacement can occur in any fashion and using any effect, such as a cross-fade, a pixeling-out transition, an overlay, or the like. In some embodiments, the first game and the second game can be joined seamlessly, thereby presenting a single game experience that includes features of a first game and a second game. For example, in one such example embodiment, a bonus round of a second game can be integrated into the action of a first game by presenting screen in which input is received to select objects having a monetary value (as is common in gambling game bonuses) that is themed to match the first game. In this manner, in some embodiments, it would appear to the player that the selection of bonus objects in the second game is part of, or a stage in, the first game.

In an alternate embodiment, the first game can remain displayed, with the second game displayed in a separate window or area, such as through a picture-in-picture effect, split screen effect, multi-screen effect, or the like. Further, in some embodiments, the displays can allow for movement or animation across different windows or areas in which the first game and second game are displayed, thereby allowing for visual interaction between the games, even though the games are conducted independently. In further embodiments of the invention, a game device 100 can include multiple displays, and the first game and second game can be displayed in different displays, or together across multiple displays. Again, in some embodiments, the multiple displays can be independent or can be integrated to allow multi-screen objects and multi-screen movement between displays.

In other embodiments of the invention, the second game can be triggered for play at a different game device 100 or at a different time. In one such embodiment, a server 200 can store the fact of the triggering of the second game. In some embodiments, by "storing" the fact that the transition point has been reached, and a second game has been triggered, a server 200 can store data in a database of users and/or game devices 100 that associates the user and/or game device 100 with the transition point and/or data representing the transition point. In at least one embodiment, a database can identify users and/or game devices 100 in any manner, including by user name, device number (such as mobile telephone number, IMEI number, IMSI number, MAC or network address, or the like), IP address, account number, social media account, or other identifier. In some embodiments, when a game device 100 receives input identifying a record at the database stored at the server, the second games that have been triggered for play at the game device 100 can be determined from the database.

In another embodiment of the invention, the device conducting the second game and the device conducting the first game can be modular. For example, in at least one embodiment, a second game module can dock with a first game device, or vice versa (a first game module can dock with a second game device). In some embodiments, when docked, the second game can occur on the second game module and the first game occurs on the first game device (or vice versa).

In some embodiments, a game device 100 can conduct 306 a second game in response to reaching a transition point in a first game. In another embodiment, the game device 100 conducting the second game can be a casino game device, such as an electronic gaming machine, electronic table game, or the like.

In a further embodiment, a single game device 100 can conduct the first game and second game. In another embodiment, separate game devices 100 can conduct a first game and the second game. For example, in at least one embodiment, the game device 100 conducting the first game can be an arcade game and the game device 100 conducting the second game can be an electronic gaming machine, electronic table game, or the like.

In some embodiments, when the first game and second game are conducted on separate game devices 100, a game device 100 conducting the first game can communicate with a server 200. More specifically, in some embodiments, the server 200 can receive a communication from the game device 100 conducting the first game identifying a transition point that was reached at the game device 100. In some embodiments, the server 200 can then make that available to a game device 100 configured to conduct a second game, such that the server 200 that can act as an intermediary between game devices 100. It some embodiments, the transfer can occur more or less in real time, or the transfer can be delayed, with the server 200 storing the data identifying the transition point for at least some time.

In some embodiments, the server 200 can be part of, or configured for communication with, a player tracking and/or player loyalty system operating in connection with one or more game operators. In some such embodiments, a server 200 or game device 100 can utilize the player database to store records of a transition points reached during first games. In some embodiments, the transition point can be accessed by the user at a game device 100 in communication with the player tracking and/or player loyalty system. For example, in at least one embodiment, the user can identify himself or herself at the game device 100 using an encoded card, personal identification number ("PIN"), user number or identifier, radio frequency identification ("RFID") transponder, mobile device, or other means for identifying and/or authenticating the user to the game device 100. In some embodiments, after being identified, the second game triggered by the transition point can be conducted for the player at the game device 100.

In another example embodiment, a server 200 can be part of, or configured for communication with, a social network site. In some such optional embodiments, a server 200 can utilize the user database to store records of a transition points in the social network profile for the user. In some embodiments, the transition point can be accessed at a game device 100 which communicates with the social network. For example, in some embodiments, the game device 100 can communicate via the world wide web, virtual private network ("VPN"), local area network ("LAN"), wide area network ("WAN"), mobile broadband, WiFi®, or the like with the social network. Optionally, in some embodiments, the user's identity can be transmitted, such as through a username and password, biometrics, caller ID, automatic number identification ("ANT"), account number, IP address, or other identifying data, to access the correct profile on the social network. In some embodiments, after being identified, the second game can be triggered by the transition point, and can be conducted for the player at the game device 100.

In some embodiments, the game device 100 can conduct the second game. In an optional embodiment, the second game can be conducted logically independent of the first game. That is, in such embodiments, the outcome of the second game can be entirely determined based on a random number generated during the second game, and is entirely independent of the conduct of the first game. For example, in some embodiments, the second game can be a wagering game of any format, such as a reel slot game, live or electronic card game, video poker game, blackjack game, roulette game, keno or other numbers game, baccarat game, lottery game, pull-tab game, or any other game in which a mandatory wager is received 400 from a user (such as through a game device interface 202), with the wager staked on the second game outcome. In some embodiments, when the second game is conducted, it is conducted solely based on the rules of the second game and a randomly generated number 406, as if the sole role of the first game was to trigger the game with no interaction between the first game and second game. Thus, in some embodiments, the second game outcome is determined 408 solely based on the random number generator ("RNG"). It should be noted that certain second games triggered by the first game can be wager-free, i.e., free spins. For example, in some embodiments, certain transition points can trigger a second game that does not require a wager because, for example, of the difficulty in reaching/attaining the transition point. More specifically, in some embodiments, the wager staked on the second game is resolved based on the second game outcome. In one such optional embodiment, the second game can be determined entirely or predominantly based on chance, e.g., a random event, and can result in either a loss, in which case the wager is collected, or a win, in which case a payout is issued 410. In some embodiments, certain second games can also include pushes or ties, in which case the wager is returned in some embodiments.

In at least one embodiment of the invention, the second game can be generated after the transition point is reached. Thus, in such an embodiment, a handoff can occur in which the game device 100 conducts a first game, and then conducts a second game when a transition point is reached. Optionally, in some embodiments, the game device 100 can return to the first game after the second game outcome is generated.

In another embodiment, the second game outcomes can be generated prior to, or simultaneous with, the conduct of the first game. Thus, in at least one embodiment, a set of second game outcomes can be generated and stored at the game device 100. As transition points are reached, the pre-generated second game outcome can be selected, either in a predefined manner or randomly. In one such example, a set of three second game outcomes can be generated in the form of a minor win, a loss, and a minor win. In some embodiments, as each of three transition points are reached, the pre-generated second game outcomes can be utilized. In one example, the second game outcomes could be utilized serially (e.g., minor win, loss, minor win) as the transition points are reached serially. In another example, a second game outcome could be randomly selected from the set as the transition points are reached (e.g., the second game outcomes could be selected "out of order"). In a variation on such an embodiment, the set of second game outcomes can be larger than the quantity of transition points in the first game. In one such non-limiting example, a set of ten second game outcomes can be pre-generated, with three of the second game outcomes selected as each of three transition points are reached.

In another embodiment of the invention, second game outcomes can be generated simultaneously with the conduct of the first game, such that the second game and first game can be conducted more-or-less simultaneously. In one such optional embodiment, transition points can merely serve to select the second game outcome that was generated at the time the transition point was reached. For example, in some embodiments, twelve second game outcomes can be generated during the course of a first game, but since transition points are reached when the fourth, seventh, and eighth second game outcomes are generated, only the fourth, seventh, and eighth second game outcomes can be used to resolve the wager.

In some embodiments, the second game can be shown at a display. For example, in some embodiments, striking a specified target can be a transition point, which causes the game device 100 to generate and display a reel slot game that was triggered by the transition point. In some embodiments, the outcome of the second game can then be generated (again, independent of the first game and based solely on a randomly generated number) and displayed in the form of reel slot symbols lying along pay lines. In some embodiments, the second game of such an optional embodiment can replace the display of the first game (e.g., the first game is paused while the second game supplants the first game at the display), or the second game can be displayed on a secondary display at the game device 100 (e.g., the game device 100 includes two separate displays, one of which shows the first game while the other shows the second game), or the second game can be displayed in a window on the same display as the first game (e.g., the game device 100 include a single display, which shows the first game and second game in separate windows).

Alternatively, in some embodiments, the second game may not be displayed at the game device 100. Rather, in some embodiments, striking a specified target can be a transition point which causes the game device 100 to conduct a reel slot game internally, with only the second game outcome displayed in the form of the award for the wager. Some embodiments can provide the illusion that striking the specified target resulted in an award, while in reality, striking the specified target triggered a second game which resulted in an award.

It should be further noted that a transition point can lead to different second games depending on the first game in which the transition point is received. For example, certain first games can be associated with second games with a higher hit frequency, but lower payouts, while other first games can be associated with second games with a lower hit frequency, but higher payouts.

Similarly, in some embodiments, the first game can include multiple transition points with different transition points associated with second games that can differ in their mathematical model. For example, in some embodiments, certain transition points can be associated with mathematical models with a higher payback percentage (or the like) while other transition points can be associated with mathematical models with a lower payback percentage (or the like). In one such non-limiting example, the mathematical model associated with the second game at each transition point can be determined in a random or weighted random manner. Thus, in one such example, as each transition point is reached, a random process is conducted to determine the mathematical model associated with the second game conducted in response to that transition point. In some embodiments, after the mathematical model is randomly determined, the second game can be conducted and an outcome can be generated. More concretely, in one example, a transition point could have a 20% probability of leading to a second game with a 97% payback model, a 30% probability of leading to a second game with a 95% payback model, and a 50% probability of leading to a second game with a 92% payback model. In some embodiments, a random draw can occur when that transition point is encountered to determine which of the mathematical models will apply to the second game to be conducted. In one example, the 92% payback model can be selected by the random draw, which leads to the conduct of a second game with a 92% payback model.

In another example, transition points can each be associated with a second game with a fixed mathematical model, where the mathematical model can vary based on the particular transition point. For example, in a first game in which transition points are represented by targets, certain targets (for example, aircraft carriers) can be associated with a second game with one mathematical model (for example, 99% payback), while other targets (for example, submarines) can be associated with a second game with a different mathematical model (for example, 95% payback). In some embodiments, the mathematical model can be adjusted by increasing or decreasing the hit frequency (i.e., the ratio of winning outcomes to losing outcomes), by adjusting the pay table (i.e., the amount paid for winning and/or losing outcomes), or any other manner understood in the art.

Figure 4:
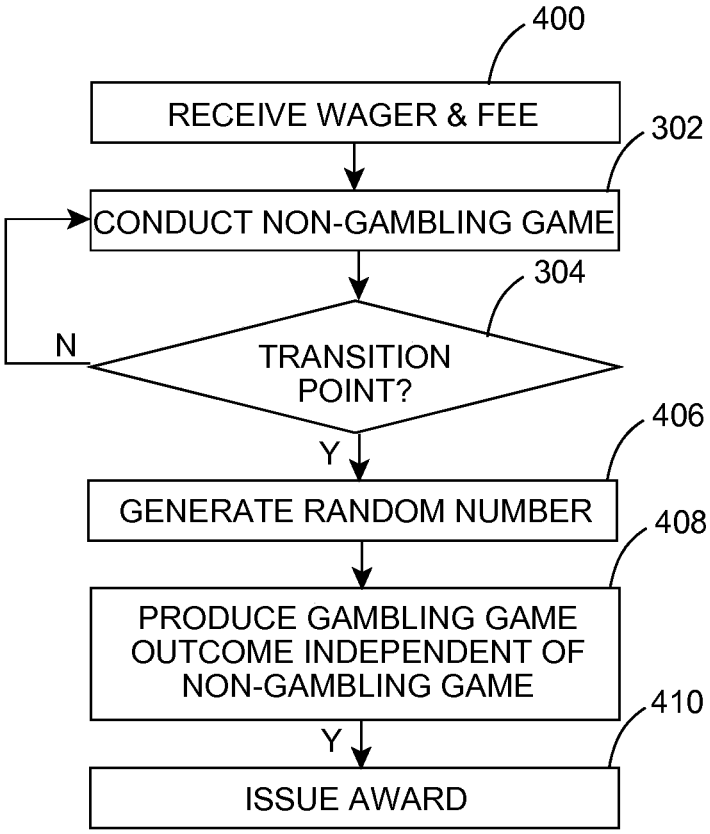
FIG. 4 is a flowchart of a method according to an embodiment of the invention.

Additionally, as illustrated in FIG. 4, the nature of the payouts and awards can be structured so that the game device 100 always returns something, although this can be achieved by how the fees and wagers are handled. For example, in at least one embodiment, the game device can utilize a mathematical model in which all outcomes in the second game, whether winning or losing outcomes, are paid. For example, in at least one embodiment, a pay table can be defined for a second game in which the lowest payout is five credits. In a second game in which the wager is ten credits, the house can always collect five credits at each transition point, while the player will always receive at least five credits (possibly more, if the second game outcome is a winning outcome) at each transition point.

In another example, the game device 100 can always return the fee (or a portion of the fee) associated with the first game, while any payout associated with the wager can be determined by the second game. Thus, in such embodiments, the game device 100 can also return something. For example, in some embodiments, a game device 100 can receive $5.00, with $1.00 allocated to a fee for the first game and $4.00 allocated to a wager on the second game. In some embodiments, when a transition point is reached in the first game, a second game can be conducted with $4.00 staked on the outcome. In some embodiments, if the outcome of the second game is a losing outcome, the payout would be $0.00 from the second game (although, as mentioned above, in alternate optional embodiments, losing outcomes could also result in a payout). However, in some embodiments, if the $1.00 fee was allocated with $0.50 allocated to a retained fee and $0.50 to a return fee, the game device 100 would issue a total payout of $0.50. Thus, in this example, $4.00 was lost on the second game, $0.50 was assessed as a fee for the first game, and $0.50 was returned to the player. Alternatively, in some embodiments, if the second game resulted in an outcome associated with a payout of three times the wager, the payout from the second game would be $12.00. Again, in some embodiments, if the $1.00 fee was allocated with $0.50 to a retained fee and $0.50 to a return fee, the game device would award a total payout of $12.50 (e.g., $12.00 won from the second game plus $0.50 returned from the first game, with $0.50 assessed as a fee for the first game). In at least one embodiment, the entire fee can be returnable, with no retained fee for the first game. Thus, in the example above, conduct of the game can always result in a return of at least $1.00, with any additional return being based on a $4.00 wager on the second game. Such a system would provide a game that always pays something. Alternatively, in some embodiments, the entire fee could be retained, with none of the fee returned to the player. In such a system, only the win from the second game would be paid to the player. In some embodiments, a casino or other operator cannot change the fee percentages and payouts of the games, ensuring the games are not overly "tightened." In other embodiments, the percentages and payouts can be fully adjusted.

The amounts allocated between wagers and fees can vary in some embodiments. For example, in at least one embodiment, the entire fee can be returned to the player to provide some positive feedback at each transition point. In an alternate embodiment, no fee can be assessed, and the entire amount debited at each transition point can be allocated to a wager. In some embodiments, the allocation of the wagers and fees can be determined based on the first game (e.g., the first game's pace, difficulty, speed, or the like). In another embodiment, the ratio between the wagers and fees can be set by the casino operator. For example, in some embodiments, a lower-fee/no-fee game (or a higher-wager/all-wager game) can feel more like a slot machine in both time-on-device and expected value to the player. In yet another embodiment, the ratio between the wagers and fees can be set by the player. For example, an "Easy" setting can allocate more to the return fee than the wager, e.g., 60% to the return fee and 40% to the wager, as compared to a "Difficult" setting which allocates more to the wager than the return fee, e.g., 40% to the return fee and 60% to the wager. In such embodiments, over the course of an equal number of transition points, the "Easy" setting can tend to keep the player in the game by returning fees to the player, although the player can simultaneously be wagering less and, presumably, be eligible for lower payouts in the second game. Conversely, the "Difficult" setting can tend to be more volatile insofar as the player is wagering more and, presumably, is eligible for greater payouts in the second game.

Similarly, in at least one embodiment, the percentage of fees returned by the first game and payback percentage of the second game can be adjustable. For example, in at least one embodiment, the overall return (i.e., fee return percentage and payback percentage) can be constant, but the relative ratio between the two can be altered based on the skill of the player. In at least one embodiment, a determination can be made by the game device 100 of the skill level of the player. In at least one embodiment, the determination can be made through play of the first game or, additionally or alternatively, through a pre-game calibration stage. In at least one embodiment, lower skill levels can be associated with an increased fee return percentage and a lower payback percentage. Such a setting can provide a steady stream of fees returned, but with lower likelihood of winning outcomes in the second game. In some embodiments, this can make the overall return seem less volatile (although the game volatility can be substantially fixed). In the same optional embodiment, higher skill levels can be associated with an increased payback percentage and a lower fee return percentage. In some embodiments, such a setting can provide a smaller trickle of fees returned, but with a higher likelihood of a winning outcome in the second game. In some embodiments, this can make the overall return seem more volatile (although the game volatility can be substantially fixed). In some embodiments, it is noted that a substantially equivalent effect can be created by adjusting the amount of fees returned in the first game and the size of the payouts in the second game based on the skill level of the player. Thus, in at least one embodiment, lower skill levels can have a higher percentage of the fees returned by the first game and smaller payouts associated with the second game, while higher skill levels can have a lower percentage of the fees returned by the first game and larger payouts associated with the second game.

In some embodiments, the first game can only affect the display of the game, without affecting the conduct or structure of the underlying second game. For example, in at least one embodiment, the first game (or the player input received during the first game) may not affect the odds of winning the second game, the payout, the payback percentage, the hold, the expected value or return, or other metric by which the second game is measured.

However, in another embodiment, different transition points in the first game can be associated with different fees and/or mathematical models for second games. For example, in at least one embodiment directed to a shooting game, different targets can be associated with a different fee. In at least one embodiment, the ratio of fee to wager can be randomly determined as each target is hit (i.e., as each transition point is encountered). For example, in some embodiments, a random process can determine that, of the $1.00 debited at a first target, $0.10 will be allocated to a fee that is returned to the player and $0.90 will be exposed to the second game as a wager. Thus, in some embodiments, when the first target is hit, a payment of $0.10 plus any win from the second game based on the $0.90 wager would be issued to the player. Continuing with the example, a random process can determine that at a second target, a $1.00 debit will be allocated with $0.40 to a fee that is subsequently returned to the player and $0.60 will be exposed to the second game as a wager. Thus, when the second target is hit, a payment of $0.40 plus any win from the second game based on the $0.60 wager would be issued to the player.

In some embodiments, in addition to, or in place of, a return fee, a player can be rewarded based on the first game independent of the outcome of the second game. For example, in at least one embodiment, certain tasks within the first game can require skill to accomplish. In at least one embodiment, an award can be issued based on the skill with which the task is accomplished. In at least one embodiment, the award can be based on a predefined schedule of outcomes. For example, in a target shooting game, an award can be issued based on, for example, one or more of: the number of targets hit, the speed with which targets are hit, the number of targets hit within a particular time span, the accuracy with which targets are hit, or any other measure. In another embodiment, some randomization can be introduced by using the skill to determine a reward level, but determining the exact amount of the award within that reward level in a random or weighted random manner. In one such embodiment, for example, a multi-dimensional pay table can be generated, with the skill level determining one coordinate of the award in the pay table, and a random process (such as a random number generator) determining the second coordinate of the award in the pay table.

In yet another embodiment, the fee can be fixed for any particular transition point. For example, in a first game directed to target shooting, certain targets can be assigned a split of 50% to a return fee and 50% to a wager, while other targets can be assigned a split of 25% to a return fee and 75% to a wager. Thus, in one example embodiment, a debit of $1.00 can be allocated with a split of $0.50 as a wager and $0.50 as a fee for blue targets, while a debit of $1.00 can be allocated with a split of $0.75 as a wager and $0.25 as a fee for red targets.

In another example embodiment, the user can be permitted to input an election regarding the triggering of a second game upon reaching a transition point. For example, in at least one embodiment, the game device 100 can receive input to select the specific first game to conduct upon reaching a transition point. Thus, in at least one embodiment, a game device 100 can generate a menu of second game selections at a transition point and receive input selecting one or more of the second games presented in the menu. In some embodiments, the game device 100 then conducts the second game(s) in response to the selection received.

In some further embodiments, a user may not be provided with any selection regarding the triggering of a second game upon reaching a transition point. For example, the second game can be immediately conducted at the game device 100, without any selection from the user, with the second game either displayed or hidden from the player. In an embodiment in which the second game is hidden from the player, the illusion would be created that the first game is conducted without interruption, with payouts being received at the various transition points seamlessly and automatically.

In some further embodiments of the invention, the user may, or may not, be informed of the location or results that occur in the second game at any specific transition points. Rather, in some embodiments, a player can play an entire level, passing through one or more transition points at which second games occurred outside the view of the player, with the overall outcome only displayed at the end of the level. For example, $20.00 can be received for a first game that includes three transition points, with $5.00 wagered on each second game triggered at the three transition points, and $5.00 received as a return fee that is not exposed to loss through the second game. In some embodiments, as the first game is conducted, the transition points are encountered (such as by hitting one or more specified targets), and one or more second games are conducted to produce a second game outcome at teach transition point. In one example embodiment, the results are not provided at each transition point, but rather presented at the end of the level. Thus, in one example, the end of the level can end in an award of $15.00 from the initial $20.00. Again, outwardly, it would appear to the player that he or she won $15.00 for playing a level of the first game. However, internally, the game device 100 would have conducted three second games, each based on a $5.00 wager, with two second games resulting in losses and one second game resulting in a $10.00 payout. Further, combining the $10.00 payout with the $5.00 return fee (which was never exposed to loss through the second game), an overall award of $15.00 would be paid. In some embodiments, the first and/or second game may include side bets. Such side bets can be prompted and executed by one or more displays. In some embodiments, a winning player may receive a percentage of the award and the percentage may range to one hundred percent.

In another embodiment of the invention, a portion of the money received can be allocated to a pool that is resolved among multiple players of the first game and/or the second game. For example, in one such optional embodiment, $15.00 can be received, with $5.00 wagered on the second game (e.g., exposed to loss in the second game), $5.00 contributed to a pool to be distributed to one or more "winners" of the first game, and $5.00 received as a return fee (e.g., not exposed to loss in the second game). In some embodiments, at the end of the first game, one or more winners can be determined from multiple players and awarded the pool (optionally after subtracting a fee). Thus, for example, in a first game with ten players each contributing $5.00, the pool can contain $50.00. In some embodiments, at the end of the first game, a first-place winner can be awarded $20.00, a second-place winner can be awarded $15.00, and a third-place winner can be awarded $10.00, with $5.00 raked from the pool by the game operator. As discussed above, in some embodiments, the portion of the amount staked on the outcome of the second game can be resolved based on the outcome of the second game, and the portion of the amount that was received as a return fee can be returned in whole.

In at least one embodiment of the invention, separate display registers can be maintained for each aspect of the collection and use of credits deposited for play. In some embodiments, these display registers can be displayed at the gaming device display and may, or may not, correspond to an internal meter used for auditing. That is, in at least one embodiment, display registers can combine credits that are separately metered in the internal meters of the gaming device. For example, in at least one embodiment, a gaming register can display an amount to be used for wagers in the second game, while a separate non-gaming register can display an amount to be used for fees in the game. In such an optional embodiment, the separate gaming and non-gaming registers can correspond to separate gaming and non-gaming meters or can correspond to a single "coin in" meter.

In a non-limiting example embodiment, one hundred dollars can be deposited into the game device, with fifty dollars displayed in a gaming register and fifty dollars displayed in a non-gaming register. As play is conducted, the amount displayed in the gaming register can be decremented by the amount of wagers placed and incremented by the amount of winnings based on the wagers. Similarly, the amount displayed in the non-gaming register can be decremented by the amount of fees charged and incremented by the amount of fees returned.

As noted above, internally, in some embodiments, each of the fees (and returned fees) and the wagers (and wins) can be metered together or separately. That is, in some embodiments, a gaming meter can be separate from a non-gaming meter such that the accounting and auditing of the game device can show that gaming wins, and losses are kept separate from fees that were not exposed to loss through the second game. In some embodiments, the gaming register displayed at the gaming device can correspond to the internal gaming meter and the non-gaming register displayed at the gaming device can correspond to the internal non-gaming meter.

In at least one embodiment of the invention, the display register can display amounts tracked by multiple, separate internal meters. For example, in at least one embodiment, a single "current credits" register can be maintained that aggregates wagers (and wins) with fees (and returned fees). In some embodiments, as distinguished from the embodiment described previously, when one hundred dollars is deposited, a "current credits" register can display the amount of one hundred dollars, i.e., the total current credits. In some embodiments, as transition points are reached, the "current credits" register can be updated to display an amount that is decremented by the wager(s) plus the fee(s). In some embodiments, after the transition point, the "current credits" register can be updated to display an amount that is incremented by the winnings, if any, plus the returned fees, if any.

In some embodiments, the wagers and fees (and winnings and return fees) can be metered separately internally, even though the "current credits" display register can display the beginning balance as affected by the wagers (and winnings) plus fees (and returned fees) as a single sum. Thus, in at least one embodiment, an amount equal to the wager can be deducted from a gaming meter and wins resulting from those wagers can be added to a gaming meter. Similarly, in some embodiments, an amount equal to a fee can be deducted from a non-gaming meter and returned fees can be added to a non-gaming meter. From the perspective of the player, however, a single "current credits" register can be displayed at the game device showing the metered amounts aggregated together, even though two (or more) separate meters are maintained internally. In this manner, all credits added or deducted during the game appear the same to the player, even though the internal meters separately track which credits (or credit amounts) are attributable to gaming or non-gaming activities.

Alternatively, or additionally, in some embodiments, a gaming device can include a single "coin in" meter that corresponds to the "current credits" display register shown to the player. More particularly, internally, in some embodiments, such an optional embodiment can maintain a single "coin in" meter which tracks the amount displayed by the "current credits" register.

In a further example, separate registers can be maintained for each separate amount, including, but not limited to, a "fee in" meter that tracks the amount of fees assessed at each transition point, a "fee out" meter that tracks the amount of fees returned at each transition point, a "wager in" meter that tracks the amounts wagered, and a "winnings out" meter that tracks amounts paid as a result of the wagers in the second game.

In some embodiments, a first game can be configured with transition points with the first game having a defined end or an indefinite end. For example, in some embodiments, a first game can be conducted in discrete segments, such as levels, with each segment requiring a predefined amount of fees plus wagers. Alternatively, in some further embodiments, a first game can be conducted in an open-ended manner, with the first game continuing until the deposited fees plus wagers are exhausted.

In some embodiments of the invention, the first game can include multiple transition points. In some embodiments, the multiple transition points can be fixed or random. For example, in some embodiments, a first game can include shooting a set of targets, a fixed number of which are transition points that trigger a second game. In another example embodiment, a first game can include shooting a set of targets, a random number of which are transition points that trigger a second game.

In a further embodiment of the invention, the second game can relate to or be associated with the transition point. For example, in some embodiments, the second game associated with a small target can have a higher pay table or greater hit frequency than the second game associated with a large target. Thus, in some embodiments, although input in the first game does not affect the conduct of the second game, input in the first game can determine which second game is conducted.

In yet another embodiment of the invention, a single second game can be associated with all the transition points in a first game, but the transition point can be used to select the payout level of the second game. For example, in some embodiments, a small target can be associated with a higher payout level than a large target. However, in some embodiments, the second game outcome can still be randomly determined independent of the first game. In other words, in some embodiments, if the random number generation within the second game produces a second game outcome that is a "winning" outcome, a transition point associated with a small target can result in a payout that is larger than a transition point associated with a large target. Thus, in at least one embodiment, different transition points can enable different fixed or progressive awards within the second game.

In a further embodiment of the invention, the probability distribution of outcomes within the second game can be associated with transition points. For example, in some embodiments, a small target can be associated with a distribution of outcomes that is more likely to produce a "winning" second game outcome than a large target. Again, in some embodiments, the second game outcome can still be randomly determined independent of the first game. However, in some embodiments, a winning second game outcome can have different probabilities of being generated based on the transition point.

In another embodiment of the invention, the second game outcome can dynamically alter the first game. For example, in some embodiments, certain second game outcomes can alter or enhance the fees returned and/or create, alter, or enhance a skill-based prize that is awarded as a result of the play of the first game. In some embodiments, separate from any skill prizes associated with transition points, the first game can include side bets that are resolved based on the skill of the player. In at least one embodiment, the player can, for example, place a proposition wager that, if satisfied, can result in a payout to the player. In such embodiments, the proposition can be satisfied by the skill with which the player plays the first game. In some embodiments, such propositions could be resolved based on any objective measure, such as time, speed, accuracy, quantity, or the like. In at least one embodiment of the invention, the proposition can only have a winning or losing outcome in which the skill side bet is paid or collected, respectively. For example, in some embodiments, if the proposition is to complete a series of tasks within thirty seconds, the skill side bet can be paid if the tasks are completed within thirty seconds and collected if the tasks are not completed within thirty seconds. Alternatively, in some embodiments, the proposition can be associated with a pay table. For example, in some embodiments, if the proposition is to complete a series of tasks within thirty seconds, completing the tasks in fewer than twenty seconds can result in a higher payout than completing the tasks within twenty-one to thirty seconds.

As discussed earlier, in some embodiments, the game device 100 can be an electronic gaming machine, and activity can be tracked for a user's activity at the gaming machine for purposes of rating the player in a player loyalty/reward program. In another embodiment of the invention, a server 200 can perform player loyalty and/or player reward functions in which player units (e.g., "player points"), can be awarded based on the user activity tracked at the game device 100 in either or both of the first game and the second game.

In some embodiments of the invention, the system can enable bounties to be established or set on one or more players. For example, in some embodiments, the top five, ten, fifteen, or twenty players in a game can be labeled with a bounty for incentive reasons. In some embodiments, other players can eliminate these players rather than a player who just joined or has a low elimination score. In one non-limiting embodiment, a bounty can be established to eliminate a top five player, where the player eliminating the top five player can receive extra elimination points, and/or more multipliers on the players skill points, and/or elimination count, and/or multiplier on wager/bet per elimination, and/or other bonus features. In a further non-limiting example embodiment, when a player eliminates a third best player, until the player is eliminated, the players multiplier is a 3× multiplier, a 0.3 multiplier for skill points in game or money/bet return on an RNG gambling side gambling outcome.

In some further embodiments, in other possible games and outcomes, the more eliminations the player has, the more the multiplier increases. For example, for 115 eliminations, the multiplier is in the 11.5 or 1.15 range. In some embodiments, the system can include leaderboards based on money made throughout skilled actions or rotating due to time, (e.g., leaderboards reset at say 8 pm every day or on Friday every week).

In some embodiments, loot boxes can be implemented by the system as an incentive to log on daily, or on a certain day, or weekly, which in one non-limiting embodiment can create a targeted influx of players, or possibly event, tournament, either from player tracking encrypted accounts, or for a daily login from casino host servers, (e.g., as a closed loop system). In some embodiments, this can give players a reason to come back day after day. In some embodiments, this can be used in a variety of game genres, including, but not limited to "BRG" games, role-playing games ("RPG"), real-time strategy "RTS" games, first-person shooter "FPS" games, multiplayer online battle arena "MOBA" games, massively multiplayer online "MMO" games, rail games, arcade games, and can work for any conventional or new game genre.

In some embodiments, the loot box rewards can be paid out of a skill side of the system via an accumulating money pool. In some further embodiments, loot boxes or daily/login rewards of that same format can be used to pay in different ways other than money, such as an extra life on turn, a spawn in advantage point on a game map, or anything that can give a slight edge to the skill side that isn't too drastic on game play, but provides an incentive to log on, or go to casino and play that game on that certain day or time, or any desired time.

In some embodiments, a portion, sequence, stage, or step of the first or the second game can comprise gambling on a live and/or actual event, whether presented in real time or at a later time or date (hereinafter referred to as an "event".) In some embodiments, a transition point can comprise an outcome, status, or stage of an event. For example, in some embodiments, a wager and a game fee (which must be greater than zero) can be received through a gaming device interface from the input, where the first game can include a video feed of an event with at least one transition point defined in one or more ways by the system, and at least one outcome at any time of the event which is random or based on chance or probabilities. In some embodiments, the transition point can comprise an outcome status, or stage of an event signaling initiation of the second game or some other stage of the second game, where the second game utilizes a random number generator module to generate a gambling game outcome independent of the first game.

In some embodiments of the invention, the event can comprise any game, sporting event or other event involving an animal and/or human (e.g., such as a horse race, football game, Esports event, etc.). Some embodiments include a server and/or servers that may host all Esports games. In some embodiments, the player can proportion a wager and/or fee to an outcome, status, stage, or occurrence of the live or real event, such as a winner of the horse race, football game, Esports event, etc. In some embodiments, the player is not aware of any wager and/or fee that has been bet upon their outcome, status, stage, or occurrences. In some embodiments, many players can bet on one player's outcome, status, stage, or occurrence (e.g., inline betting), setting up a spectator type of betting event. In some embodiments, the player that bet the wager and/or fee may return to receive their winning award and/or be notified of their loss.

In some further embodiments, the live or real event can comprise a gaming tournament such as an online gaming platform where a player can proportion a wager and/or fee to an outcome, status, stage, or occurrence of one or more live games. For example, in some embodiments, the player can place a wager and/or fee on a gamer or team of gamers winning a game, reaching a level of a game, causing or being part of an event in the game, etc.

In some embodiments, at least a portion of the event can be displayed to a player in real time or near real time as part of the first game or the second game. In some embodiments, based on a fee and/or a wager placed by the player related to at least one aspect of the live or real event, and an outcome, status, stage, or occurrence of the live or real event, a payout can be applied to another portion of the first game, another game or portion of the first game, or to the second game or games. In some embodiments, at least a portion of the payout due or paid to the player can be delivered to a participant of the event (e.g., such as a jockey of a horse race, football player or team, gamer, etc.)

In some embodiments, the player can place a wager and/or fee before the live or real event occurs, and/or during the live or real event, and/or prior to an outcome, status, stage, or occurrence of the live event, at a certain time or stage of the live or real event, and/or when the live or real event starts.

In some embodiments, an event stage of the first game can lead to a portion of the first game or another non-wagering game of the first game, including, but not limited to, any non-wagering game of the first game previously described herein. In some embodiments, a live or real event stage of a second game can lead to a portion of the second game or another wagering game of the second game, including, but not limited to, any wagering game of the second game previously described herein.

Some embodiments include at least one anti-cheat process or system, including, but not limited to the use of encrypted closed loops servers, software capable of tracking when people are using proxy servers and/or VPN clone servers. Some embodiments include systems with smart phone and mobile encrypted servers that can be used to log into a game and for using a smart phone as a controller. Some embodiments include in-room gambling on encrypted closed loop servers. For example, some embodiments include the ability to use the system in a hotel room via TV and device/controller splitting bets from a skill based side, and an RNG gambling side (i.e., a game bifurcation).

Some embodiments of the invention can implement a lottery system, e.g., such as a scratch card system for prizes in a game, or for extra turns on device, etc. In some embodiments, the system can distribute to one or more players at least one scratch card system for prizes in a game, or for extra turns on device, etc.

Some embodiments of the invention can use any action in any skills-based games (including those referenced herein) as a transition point. For example, shooting an opponent can be a transition point with any of the previously described results for transition points. In some embodiments, skillful play can increase the chances of hitting a jackpot in a gambling portion of a game. Conversely, play lacking skill can decrease the jackpot chances in some embodiments. Either skillful play or wining a gambling portion can provide virtual or real currency useable as the player selects, and may include the purchase of various goods for or relating to the game. It should be noted that the skills-based games can be played without modification to the typical game play, preserving the fun and often addictive features of the original games, while adding the gambling component to further enhance the player experience. Some embodiments enable the player to wager desired amounts to increase the stakes of the gambling portion of the integrated game.

Some embodiments of the invention provide a refeed type of system in a BRG or other game. Some embodiments provide a private refeed server configured to allow a queue of players to wait for a spot on skills-based devices. In some embodiments, the server can enable players to wait to play with a professional or other highly skilled player or a specific or unknown player.

Some embodiments modify or enhance existing play in conventional games. For example, in a Fortnite® game, rather than winning by being the last player of one hundred to survive, an elimination threshold (for example, 300 eliminations) can be set as the winning accomplishment. Some embodiments include a resetting of the game or the threshold if a professional or other, specified player is eliminated. These embodiments can provide a substantially constant feed of players, and some embodiments enable gambling on every elimination which in turn allows and has the ability to start building a line for a spectator feature within a casino or other physical or virtual venue.

Conventional game developers are typically reluctant to share source code. Some embodiments can use a variety of techniques to enable enhanced interfacing and coordination with conventional games without using source code. For example, in some embodiments, game sounds or other game characteristics can be detected and used to identify certain actions taking place in the game. In some embodiments, the sound file for the type of sound applied to an object in the game helps identify the object and its value, if any. For example, if a fighter plane flies by and the player shoots it, the game interface can know what the fighter plane explosion sounds like and know how much to reward. A wide variety of analytical methods can be used to identify the sound including harmonic comparisons, sound file or profile analytics, and the like. Additionally, sound profiles can be used to provide an indication of the skill of the player in some embodiments.

Figure 5:
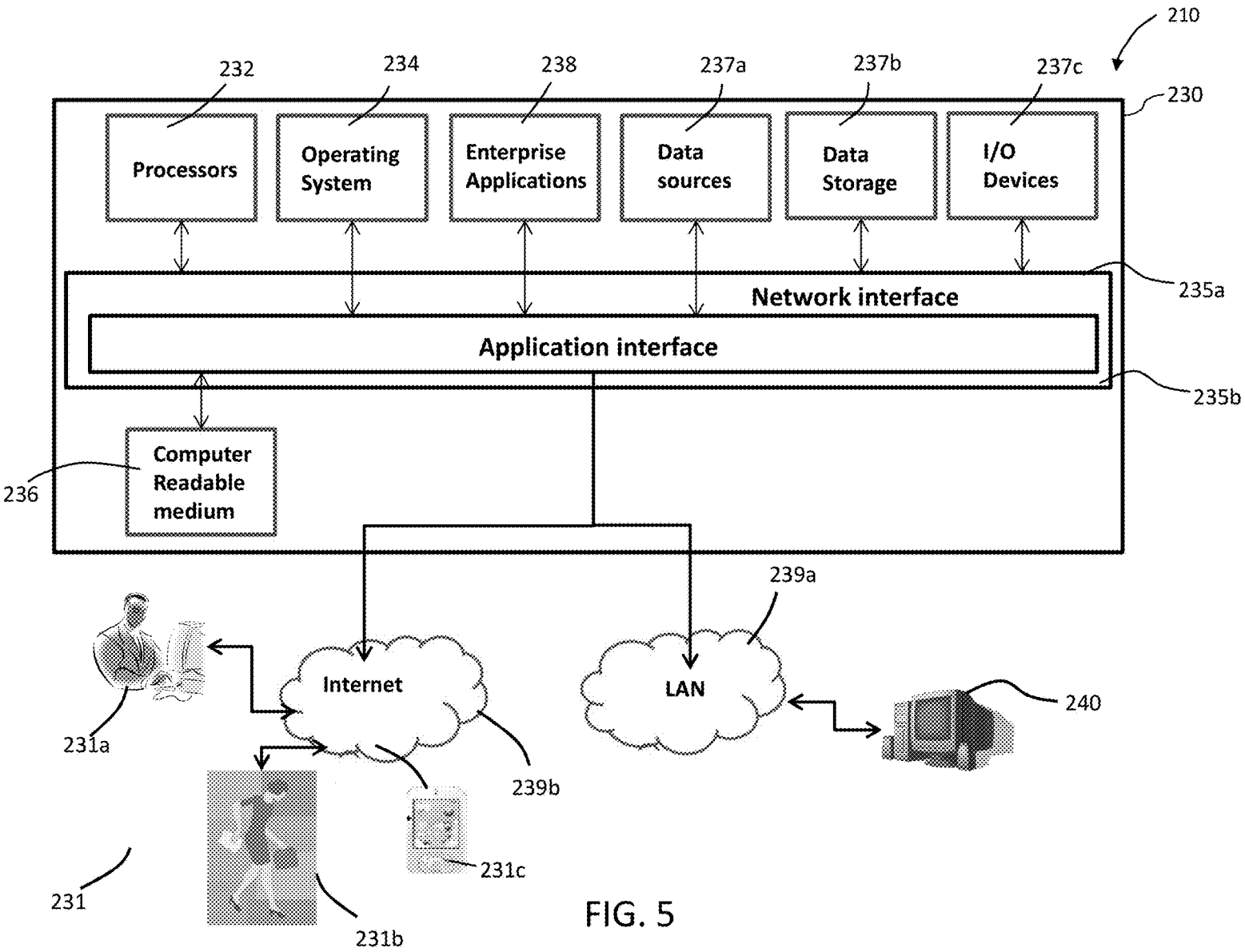
FIG. 5 illustrates a computer system enabling or comprising the systems and methods in accordance with some embodiments of the invention.

FIG. 5 illustrates a computer system enabling or comprising the systems and methods in accordance with some embodiments of the invention. In some embodiments, the computer system 210 can include and/or operate and/or process computer-executable code of one or more of the above-mentioned software modules and/or systems. Further, in some embodiments, the computer system 210 can operate and/or display information within one or more graphical user interfaces such as the GUI of FIG. 5. In some embodiments, the computer system 210 can comprise the cloud and/or can be coupled to one or more cloud-based server systems.

In some embodiments, the system 210 can comprise at least one computing device including at least one processor 232. In some embodiments, the at least one processor 232 can include a processor residing in, or coupled to, one or more server platforms. In some embodiments, the system 210 can include a network interface 235*a* and an application interface 235*b* coupled to the least one processor 232 capable of processing at least one operating system 234. Further, in some embodiments, the interfaces 235*a*, 235*b* coupled to at least one processor 232 can be configured to process one or more of the software modules (e.g., such as enterprise applications 238). In some embodiments, the software modules 238 can include server-based software, and can operate to host at least one user account and/or at least one client account, and operating to transfer data between one or more of these accounts using the at least one processor 232.

With the above embodiments in mind, it should be understood that the invention can employ various computer-implemented operations involving data stored in computer systems. Moreover, the above-described databases and models described throughout can store analytical models and other data on computer-readable storage media within the system 210 and on computer-readable storage media coupled to the system 210. In addition, the above-described applications of the system can be stored on computer-readable storage media within the system 210 and on computer-readable storage media coupled to the system 210. These operations are those requiring physical manipulation of physical quantities. Usually, though not necessarily, these quantities take the form of electrical, electromagnetic, or magnetic signals, optical or magneto-optical form capable of being stored, transferred, combined, compared and otherwise manipulated. In some embodiments of the invention, the system 210 can comprise at least one computer readable medium 236 coupled to at least one data source 237*a*, and/or at least one data storage device 237*b*, and/or at least one input/output device 237*c*. In some embodiments, the invention can be embodied as computer readable code on a computer readable medium 236. In some embodiments, the computer readable medium 236 can be any data storage device that can store data, which can thereafter be read by a computer system (such as the system 210). In some embodiments, the computer readable medium 236 can be any physical or material medium that can be used to tangibly store the desired information or data or instructions and which can be accessed by a computer or processor 232. In some embodiments, the computer readable medium 236 can include hard drives, network attached storage (NAS), read-only memory, random-access memory, FLASH based memory, CD-ROMs, CD-Rs, CD-RWs, DVDs, magnetic tapes, other optical and non-optical data storage devices. In some embodiments, various other forms of computer-readable media 236 can transmit or carry instructions to a computer 240 and/or at least one user 231, including a router, private or public network, or other transmission device or channel, both wired and wireless. In some embodiments, the software modules 238 can be configured to send and receive data from a database (e.g., from a computer readable medium 236 including data sources 237*a* and data storage 237*b* that can comprise a database), and data can be received by the software modules 238 from at least one other source. In some embodiments, at least one of the software modules 238 can be configured within the system to output data to at least one user 231 via at least one graphical user interface rendered on at least one digital display.

In some embodiments of the invention, the computer readable medium 236 can be distributed over a conventional computer network via the network interface 235*a* where the system embodied by the computer readable code can be stored and executed in a distributed fashion. For example, in some embodiments, one or more components of the system 210 can be coupled to send and/or receive data through a local area network ("LAN") 239*a* and/or an internet coupled network 239*b* (e.g., such as a wireless internet). In some further embodiments, the networks 239*a*, 239*b* can include wide area networks ("WAN"), direct connections (e.g., through a universal serial bus port), or other forms of computer-readable media 236, or any combination thereof.

In some embodiments, components of the networks 239*a*, 239*b* can include any number of user devices such as personal computers including for example desktop computers, and/or laptop computers, or any fixed, generally non-mobile internet appliances coupled through the LAN 239*a*. For example, some embodiments include personal computers 240 coupled through the LAN 239*a* that can be configured for any type of user including an administrator. Other embodiments can include personal computers coupled through network 239*b*. In some further embodiments, one or more components of the system 210 can be coupled to send or receive data through an internet network (e.g., such as network 239*b*). For example, some embodiments include at least one user 231 coupled wirelessly and accessing one or more software modules of the system including at least one enterprise application 238 via an input and output ("I/O") device 237*c*. In some other embodiments, the system 210 can enable at least one user 231 to be coupled to access enterprise applications 238 via an I/O device 237*c* through LAN 239*a*. In some embodiments, the user 231 can comprise a user 231*a* coupled to the system 210 using a desktop computer, and/or laptop computers, or any fixed, generally non-mobile internet appliances coupled through the internet 239*b*. In some further embodiments, the user 231 can comprise a mobile user 231*b* coupled to the system 210. In some embodiments, the user 231*b* can use any mobile computing device 231*c* to wireless coupled to the system 210, including, but not limited to, personal digital assistants, and/or cellular phones, mobile phones, or smart phones, and/or pagers, and/or digital tablets, and/or fixed or mobile internet appliances.

Any of the operations described herein that form part of the invention are useful machine operations. The invention also relates to a device or an apparatus for performing these operations. The apparatus can be specially constructed for the required purpose, such as a special purpose computer. When defined as a special purpose computer, the computer can also perform other processing, program execution or routines that are not part of the special purpose, while still being capable of operating for the special purpose. Alternatively, the operations can be processed by a general-purpose computer selectively activated or configured by one or more computer programs stored in the computer memory, cache, or obtained over a network. When data is obtained over a network the data can be processed by other computers on the network, e.g. a cloud of computing resources.

The embodiments of the invention can also be defined as a machine that transforms data from one state to another state. The data can represent an article, that can be represented as an electronic signal and electronically manipulate data. The transformed data can, in some cases, be visually depicted on a display, representing the physical object that results from the transformation of data. The transformed data can be saved to storage generally, or in particular formats that enable the construction or depiction of a physical and tangible object. In some embodiments, the manipulation can be performed by a processor. In such an example, the processor thus transforms the data from one thing to another. Still further, some embodiments include methods can be processed by one or more machines or processors that can be connected over a network. Each machine can transform data from one state or thing to another, and can also process data, save data to storage, transmit data over a network, display the result, or communicate the result to another machine. Computer-readable storage media, as used herein, refers to physical or tangible storage (as opposed to signals) and includes without limitation volatile and non-volatile, removable and non-removable storage media implemented in any method or technology for the tangible storage of information such as computer-readable instructions, data structures, program modules or other data.

Although method operations can be described in a specific order, it should be understood that other housekeeping operations can be performed in between operations, or operations can be adjusted so that they occur at slightly different times, or can be distributed in a system which allows the occurrence of the processing operations at various intervals associated with the processing, as long as the processing of the overlay operations are performed in the desired way.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A machine, comprising:

a non-transitory computer readable medium including program logic instructions;

a game device interface configured and arranged to detect an input associated with a monetary value;

a game device controller in communication with the game device interface, the non-transitory computer readable medium, and at least one of a software and hardware-based random number generator, wherein the game device controller is configured to communicate to a game device display of the game device interface, and is operative to execute the program logic instructions comprising:

receiving a fee through the game device interface from the input, the fee being greater than zero and the fee being from a player;

dynamically determining a first portion of the fee to return to the player and a second portion of the fee used to conduct a second game;

conducting, in response to receipt of a game fee, a first game by the game device controller and receiving player input data, wherein the first game includes transmission of data identifying at least one transition point;

generating a first game outcome based, at least in part, on the player input data; and conducting the second game, which is logically independent of the first game, by the game device controller solely in response to the first game reaching the at least one transition point, wherein the second game utilizes the random number generator to generate a gambling second game outcome independent of the first game and the player input data;

determining by the game device controller whether the second game outcome is a winning outcome;

issuing a payout through a payout device of the game device interface when the second game outcome is a winning outcome independent of the conduct of the first game, wherein the payout is partially based on the second portion of the fee; and returning the first portion of the fee at the at least one transition point, wherein the first portion of the fee is independent of fees from other players.

2. The machine of claim 1, wherein the second portion of the fee is a wager.

3. The machine of claim 1, wherein the returned first portion of the fee comprises at least a portion of the game fee.

4. The machine of claim 1, wherein determining whether the second game outcome is a winning outcome comprises comparing the second game outcome to a predefined schedule of winning outcomes by said game device controller.

5. The machine of claim 1, wherein said program instructions further comprise issuing an award based on said game fee and said first game outcome.

6. The machine of claim 1, wherein said program instructions further comprise:

displaying said first game at said game device display while conducting said first game; and conducting said second game without displaying said second game at said game device display.

7. The machine of claim 1, wherein the first portion of the fee is returned to the player independent of a chance based outcome.

8. An electronic game machine, comprising:

a non-transitory computer readable medium including program logic instructions;

a game device interface configured and arranged to detect an input associated with a monetary value and at least one event feed;

a game device controller in communication with the game device interface, the non-transitory computer readable medium, and at least one of a software and hardware-based random number generator, wherein the game device controller is configured to communicate to a game device display of the game device interface, and is operative to execute the program logic instructions comprising:

receiving a wager and a game fee through the game device interface from the input, the game fee being greater than zero and the game fee being from a player;

dynamically determining a first portion of the game fee to return to the player and a second portion of the game fee that is not returned to the player;

conducting, in response to receipt of the game fee, a first game by the game device controller and receiving player input data, wherein the first game includes transmission of data identifying at least one transition point;

generating a first game outcome based, at least in part, on the player input data; and conducting a second game, which is logically independent of the first game, by the game device controller solely in response to the first game reaching the at least one transition point, wherein the second game utilizes the random number generator to generate a gambling second game outcome independent of the first game and the player input data;

determining by the game device controller whether the second game outcome is a winning outcome;

issuing a payout based on the wager through a payout device of the game device interface when the second game outcome is a winning outcome independent of the conduct of the first game; and returning the first portion of the game fee at the at least one transition point to the player, wherein the first portion of the game fee is independent of game fees from other players.

9. The electronic game machine of claim 8, wherein the game device controller is operative to execute the program instructions comprising detecting and displaying at least one live or real event feed on the game device display.

10. The electronic game machine of claim 9, wherein the player input data comprises an outcome from the at least one live or real event feed based on an outcome, status, or stage of the at least one live or real event and the player's input to the game device controller related to the at least one live or real event feed.

11. The electronic game machine of claim 8, wherein the player's input comprises a skill-based input.

12. The electronic game machine of claim 8, wherein determining whether the second game outcome is a winning outcome comprises comparing the second game outcome to a predefined schedule of winning outcomes by said game device controller.

13. The electronic game machine of claim 8, wherein said program instructions further comprise issuing an award based on said game fee and said first game outcome.

14. The electronic game machine of claim 8, wherein said program instructions further comprise:

displaying said first game at said game device display while conducting said first game; and conducting said second game without displaying said second game at said game device display.

15. The electronic game machine of claim 8, wherein the first portion of the game fee is returned to the player independent of a chance based outcome.

* * * * *